United States Patent [19]

Long et al.

[11] Patent Number: 4,793,004

[45] Date of Patent: Dec. 27, 1988

[54] DISPOSABLE BIB CONSTRUCTION

[75] Inventors: Daniel C. Long; Dale G. Welch, both of Newton, N.C.

[73] Assignee: Unico Products, Inc., Newton, N.C.

[21] Appl. No.: 152,939

[22] Filed: Feb. 5, 1988

[51] Int. Cl.[4] ..... A41B 13/10

[52] U.S. Cl. ..... 2/49 R; 2/52

[58] Field of Search ..... 2/49 R, 49 A, 52

[56] References Cited

U.S. PATENT DOCUMENTS

| | | | |
|---|---|---|---|
| D. 232,276 | 8/1974 | Anderson et al. | 2/49 R |
| D. 238,521 | 1/1976 | Andersson . | |
| 497,340 | 5/1893 | Pollitt | 2/49 R |
| 2,333,357 | 11/1943 | Bruni | 2/49 R |
| 2,469,835 | 5/1949 | McMartin . | |
| 2,782,420 | 2/1957 | Barager | 2/49 R |
| 3,001,646 | 9/1961 | Cooper . | |
| 3,146,465 | 9/1964 | Hummel | 2/49 R |
| 3,328,807 | 7/1967 | Strauss . | |
| 3,332,547 | 7/1967 | Rowe et al. | 2/49 R |
| 3,416,157 | 12/1968 | Marder et al. | 2/49 R |
| 3,452,363 | 7/1969 | Schultz . | |
| 3,540,060 | 11/1970 | Brown | 2/49 R |
| 3,583,558 | 6/1971 | Davis . | |
| 3,793,644 | 2/1974 | Kellner | 2/49 R |
| 3,945,048 | 3/1976 | Shearer . | |
| 3,995,321 | 12/1976 | Johnson . | |
| 3,999,221 | 12/1976 | Hannigan . | |
| 4,233,688 | 11/1980 | Hjerl . | |
| 4,441,212 | 4/1984 | Ahr et al. | 2/49 R |
| 4,475,250 | 10/1984 | Savin et al. | 2/52 |
| 4,523,333 | 6/1985 | Spangler . | |
| 4,601,065 | 7/1986 | Sigl et al. . | |
| 4,646,365 | 3/1987 | Suprise et al. | 2/49 R |
| 4,649,572 | 3/1987 | Roessler . | |
| 4,660,226 | 4/1987 | Quilling et al. | 2/49 R |
| 4,706,303 | 11/1987 | Van Gompel et al. . | |

*Primary Examiner*—Werner H. Schroeder
*Assistant Examiner*—J. Chapman
*Attorney, Agent, or Firm*—Bell, Seltzer, Park & Gibson

[57] ABSTRACT

A disposable bib is disclosed. The bib is constructed of a unitary sheet of drapable material. The unitary sheet has opposite top and bottom edges defining a length direction therebetween, and opposite side edges defining a width direction therebetween. A pair of slots extend along opposite side edges of the sheet. The slots define a pair of ties along respective opposite side edges of the sheet for use in securing the bib to a wearer by being tied about the neck.

30 Claims, 3 Drawing Sheets

DISPOSABLE BIB CONSTRUCTION

FIELD OF THE INVENTION

The present invention relates to bibs generally, and particularly relates to disposable bibs.

BACKGROUND OF THE INVENTION

The recent growth in the population of infants and young children has generated a substantial need for disposable bibs. In addition, the growth in the population of the elderly has generated a need for disposable bibs which can be used in nursing homes and the like. The needs created by the growth of these populations have lead to considerable interest in developing convenient, inexpensive, disposable bibs. Recently issued patents illustrative of this interest include U.S. Pat. Nos. 4,649,572 to Roessler; 4,646,365 to Suprise et al.; 4,601,065 to Sigl et al.; and 4,523,333 to Spangler.

Although bibs are commonplace items, the construction of a satisfactory bib from disposable materials, in an economical way, is not a simple matter. Some bibs, such as that disclosed in U.S. Pat. No. 4,649,572 to Roessler, require the use of an adhesive tab to secure the bib around the neck of a wearer. Other bibs, such as that disclosed in U.S. Pat. No. 4,601,065 to Sigl et al., require the use of an adhesive to form a crumb catcher at the bottom of the bib. Still other bibs, such as that disclosed in U.S. Pat. No. 3,583,558 to Davis, do not provide ties of a length sufficient to permit their convenient knotting. U.S. Pat. No. 3,999,221 to Hannigan discloses a bib with elongate ties, but the nature of their construction requires that the ties be of a slender width.

Accordingly, an object of the present invention is to provide a bib constructed from disposable material. Another object is to provide such a bib which can be constructed without the use of adhesives. A still further object of this invention is to provide a disposable bib which can be secured around the neck of a wearer with convenient, elongate ties.

SUMMARY OF THE INVENTION

The invention disclosed herein is a disposable bib, which in a first respect comprises a unitary sheet of drapable material having opposite top and bottom edges defining a length direction therebetween, and opposite side edges defining a width direction therebetween. A pair of slots extends generally along respective ones of the side edges of the sheet. Each of the slots, counting from the top of the sheet down, includes a first segment which extends generally parallel to the adjacent side edge of the sheet to a point adjacent the bottom edge of the sheet, and a second segment which extends from that point to an adjacent edge of the sheet. Each of the slots includes at least one interruption which defines a bridging interconnection. The bridging interconnection is at a location closer to the bottom edge than the top edge of the sheet. The pair of slots define a pair of ties along respective opposite side edges of the sheet. The ties can be rendered free for use by rupturing the bridging interconnections.

The invention, in a second respect, comprises a unitary sheet of drapable material. The sheet has opposite top and bottom edges defining a length direction therebetween, and opposite side edges defining a width direction therebetween. The top edge comprises a medial top edge portion and a lateral top edge portion on each side of the medial top edge portion. A pair of slots extends generally along respective ones of the lateral top edge portions and the side edges of the sheet. Each of the slots, counting from the top of the sheet down, includes a first segment which extends generally parallel to the adjacent lateral top edge portion of the sheet, and a second segment which extends generally parallel to the adjacent side edge of the sheet for a substantial portion of the length of the sheet. The second segment extends to an adjacent edge of the sheet. The pair of slots define a pair of ties along respective lateral top edge portions and opposite side edges of the sheet for use in securing the bib to a wearer by being tied about the neck.

DESCRIPTION OF THE DRAWINGS

The foregoing and other advantages of the present invention are discussed in the following detailed description and drawings, in which.

DETAILED DESCRIPTION OF THE PREFERRED EMBODIMENTS

Figure 1:
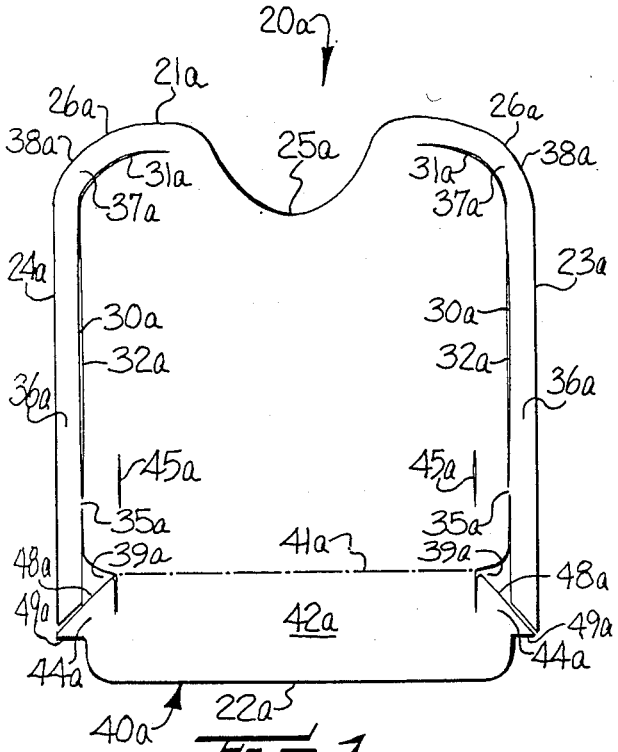
FIG. 1 is a top plan view of a first embodiment of a bib of the present invention.

As shown in FIGS. 1 through 5, a first embodiment 20*a* of the present invention comprises a unitary sheet of drapable material. The sheet has opposite top and bottom edges 21*a*, 22*a* defining a length direction therebetween, and opposite side edges 23*a*, 24*a* defining a width direction therebetween. The side edges are generally linear and parallel to one another, and the length of the unitary sheet exceeds the width thereof.

The top edge comprises a medial top edge portion 25*a* and a lateral top edge portion 26*a* on each side of the medial top edge portion. The medial top edge portion is formed in a convexly inwardly curved configuration, and adapted to be comfortably secured against the neck of a wearer.

A pair of elongate slots 30a extend generally along respective one of the lateral top edge portions and the side edges of the sheet. Each of the slots includes, counting from the top of the sheet down, three segments. The first segment 31a extends generally parallel with the adjacent lateral top edge portion of the sheet. The second segment 32a extends generally parallel with the adjacent side edge of the sheet to a point 33a adjacent the bottom edge of the sheet. The third segment 34a extends from that point to an adjacent edge of the sheet. Preferably, the third segment extends generally in the width direction from the point to an associated side edge of the sheet.

Each of the slots includes an interruption which defines a bridging interconnection 35a. The bridging interconnection 35a is positioned at a location closer the bottom edge than the top edge of the sheet. Optionally, additional bridging interconnections could be included. If numerous such bridging interconnections were included, the slots would in effect become serrated slots. In any case, the slots define a pair of ties 36a along respective lateral top edge portions and opposite side edges of the sheet, and the ties can be rendered free for use by rupturing the bridging interconnections.

Figure 5:
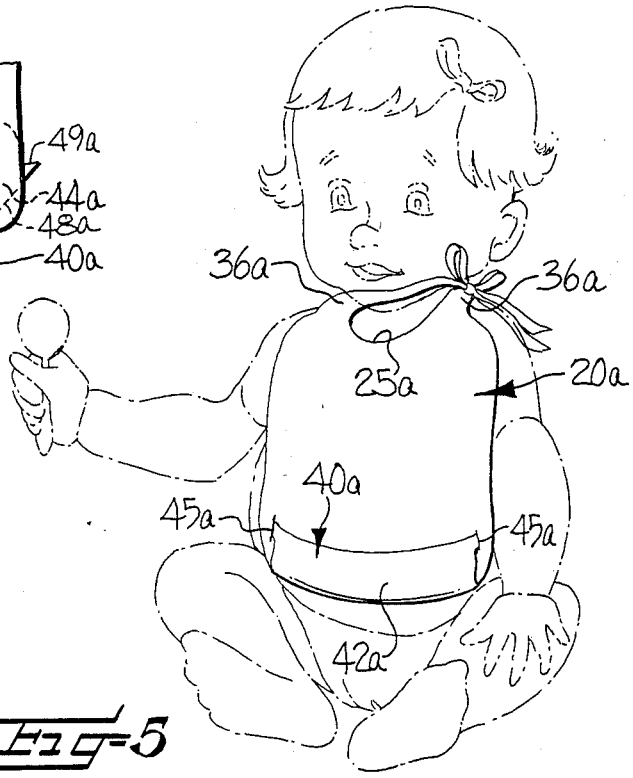
FIG. 5 is an environmental view of the bib shown in FIG. 1 in use on a wearer.
Figure 6:
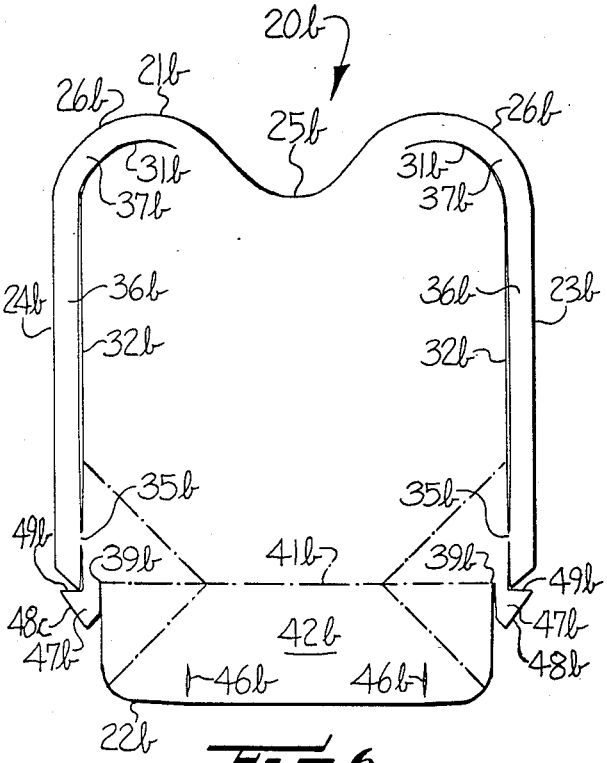
FIG. 6 is a top plan view of a second embodiment of a bib of the present invention.
Figure 7:
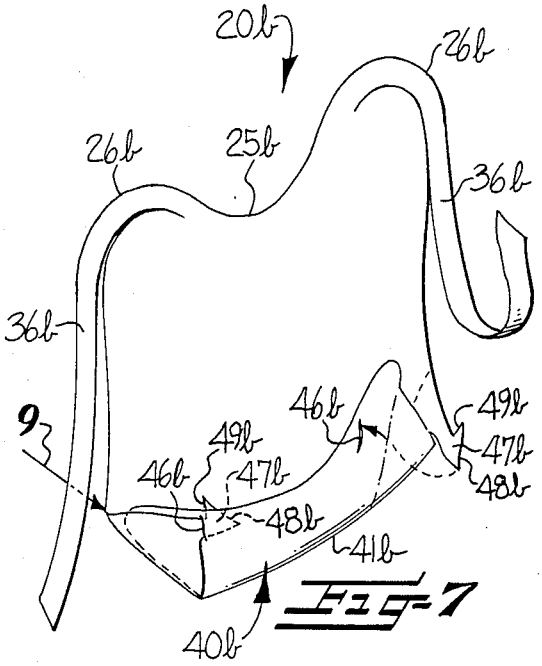
FIG. 7 is a perspective view of the bib shown in FIG. 6 having the crumb catcher panel folded partially in place.
Figure 8:
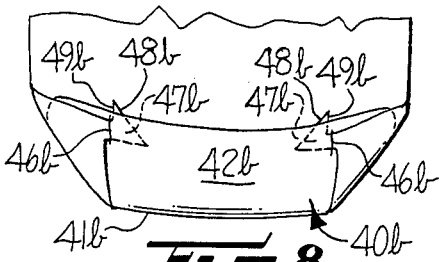
FIG. 8 is a detail view of the bib shown in FIG. 6, illustrating the crumb catcher panel folded in place.
Figure 9:
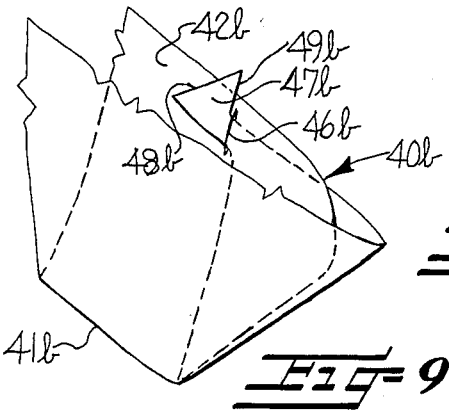
FIG. 9 is a detail view of the bib shown in FIG. 7, showing the back region indicated by arrow 9 thereof.
Figure 10:
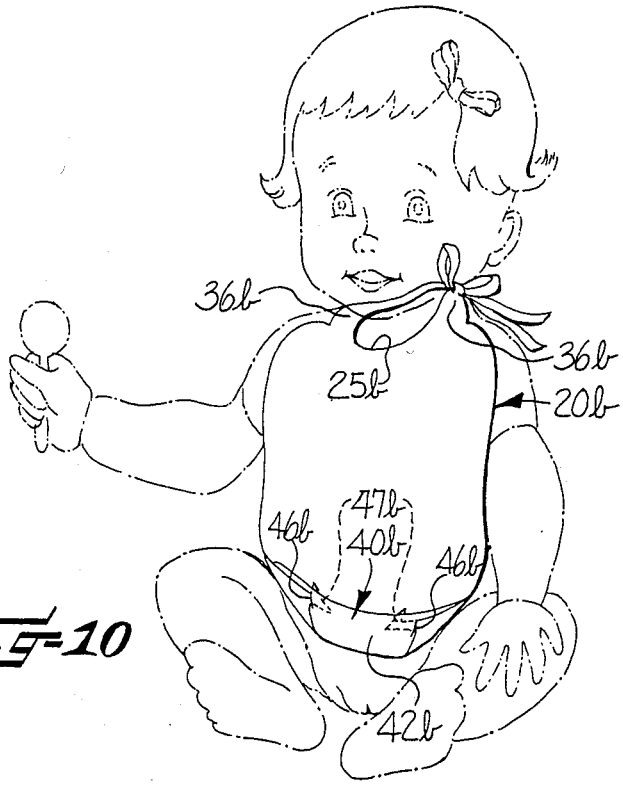
FIG. 10 is an environmental view of the bib shown in FIG. 6 in use on a wearer.
Figure 11:
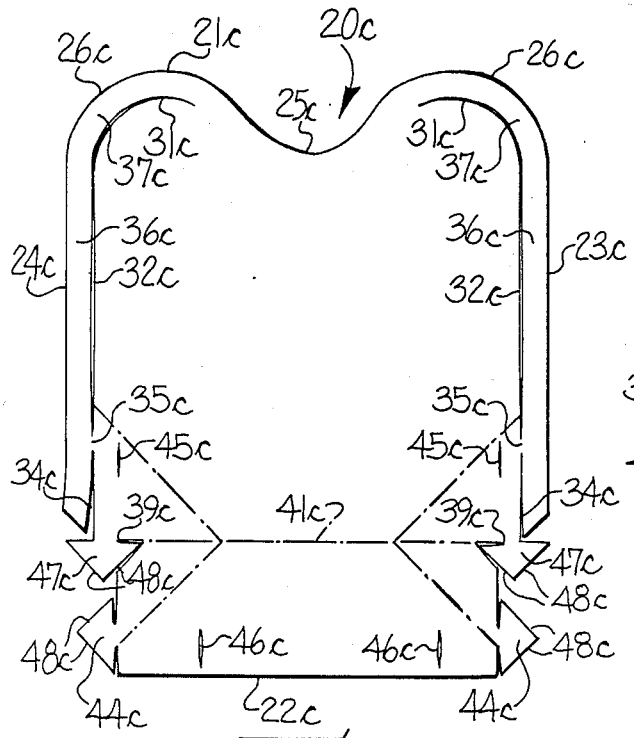
FIG. 11 is a top plan view of a third embodiment of a bib of the present invention.
Figure 12:
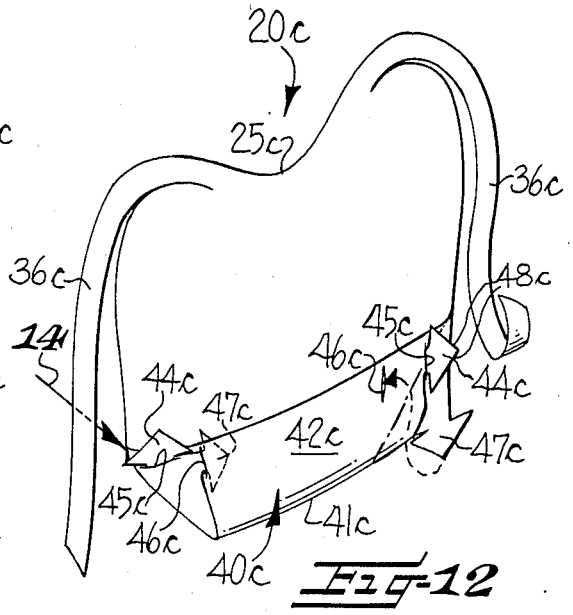
FIG. 12 is a perspective view of the bib shown in FIG. 11 having the crumb catcher panel folded partially in place.
Figure 13:
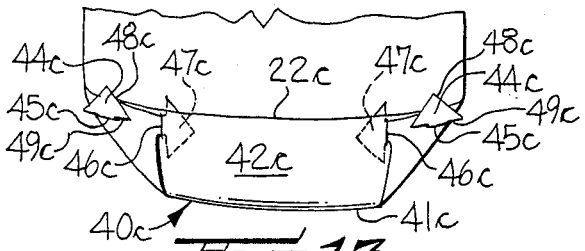
FIG. 13 is a detail view of the bib shown in FIG. 11, illustrating the crumb catcher panel folded in place.
Figure 14:
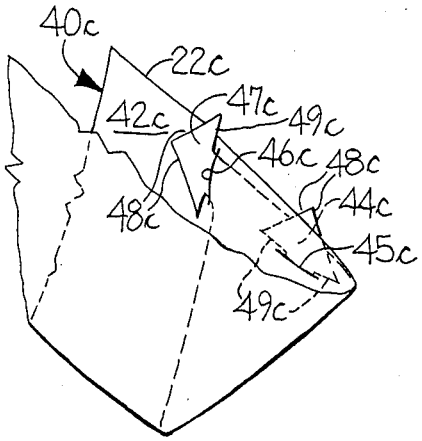
FIG. 14 is a detail view of the bib shown in FIG. 12, showing the back region indicated by arrow 14 thereof.
Figure 15:
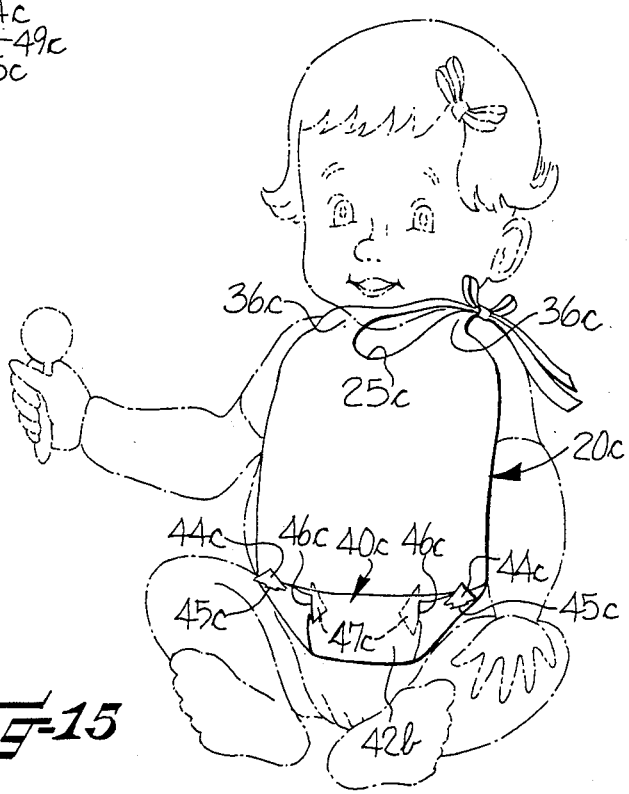
FIG. 15 is an environmental view of the bib shown in FIG. 11 in use on a wearer.

Each of the slots 30a includes an outwardly curved corner segment 37a positioned between the first segment 31a and the second segment 32a, with each tie 36a having a corresponding outwardly curved outer edge portion 38a. When the ties 36a are rendered free for use and pulled back around the neck of a wearer, the convexly inwardly curved medial top edge portion 25a of the top edge and the outwardly curved outer edge portions 38a of the ties 36a operate together to provide ties which drape neatly about the neck of a wearer while simultaneously securing the top edge portion 25a adjacent the neck of a wearer, as shown in FIG. 5.

Figure 2:
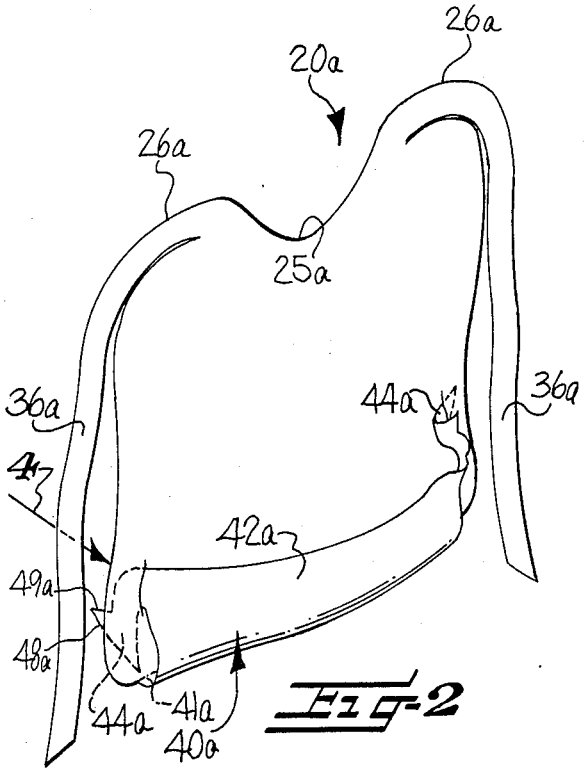
FIG. 2 is a perspective view of the bib shown in FIG. 1 having the crumb catcher panel folded partially in place.
Figure 3:
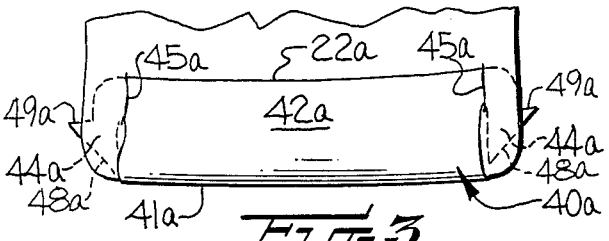
FIG. 3 is a detail view of the bib shown in FIG. 1, illustrating the crumb catcher panel folded in place.
Figure 4:
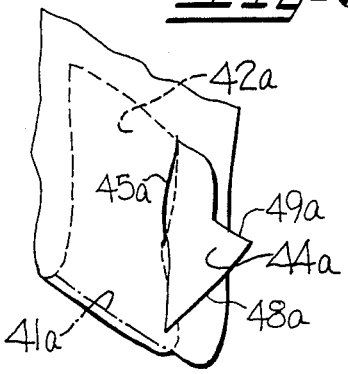
FIG. 4 is a detail view of the bib shown in FIG. 2 showing the back region indicated by arrow 4 thereof.

The first embodiment also includes a crumb catcher 40a, as best shown in FIGS. 2 and 3. More particularly, the bib 20a further comprises means defining a fold line 41a extending parallel to and spaced from the bottom edge 22a of the sheet to define a crumb catcher panel 42a between the fold line and the bottom edge. The means defining the fold line 41a is an indentation 39a formed in each side edge of the sheet. The fold line (which need not be, and preferably is not, actually drawn on the sheet material) runs between the two indentations. Attachment means are provided for securing the crumb catcher panel in an operative position wherein the crumb catcher is folded along the fold line to overlie an adjacent portion of the sheet.

The attachment means comprises an integral connector member 44a formed at each side edge of the crumb catcher panel, and a pair of relatively short slots 45a in the sheet. The relatively short slots are sized and positioned to separately receive the connector members when the crumb catcher panel is folded to its operative position.

A second embodiment 20b of the invention is shown in FIGS. 6–10. In this embodiment, the crumb catcher 40b is modified so that liquids spilled into it do not rapidly drain through side openings therein.

Like the first embodiment 20a, this second embodiment has opposite top and bottom edges 21b, 22b and opposite side edges 23b, 24b. The top edge comprises a medial top edge portion 25b and a lateral top edge portion 26b on each side thereof. A pair of elongate slots 30b extend generally along respective ones of the lateral top edge portions and the side edges of the sheet, with each of the slots including three segments 31b, 32b, 34b arranged like the three segments in the first embodiments. The slots include a bridging interconnection 35b, again like the first embodiment.

The second embodiment includes means defining a fold line 41b extending parallel to and spaced from the bottom edge 2b of the sheet to define a crumb catcher panel 22b between the fold line and the bottom edge. The means defining the fold line 41b is the terminal point of a slot 39b formed in each side of the sheet. The fold line 41b runs between these two terminal points. Attachment means are provided for securing the crumb catcher panel in an operative position, wherein the crumb catcher panel is folded along the fold line to overlie an adjacent portion of the sheet. The attachment means comprise a pair of relatively short slots 46b formed in the crumb catcher panel and an integral connector member 47b formed at each side of the sheet. The relatively short slots 46b are sized and positioned to separately receive the connector members when the crumb catcher panel 42b is folded into its operative position.

A third embodiment 20c of this invention is shown in FIGS. 11 through 15. Like the second embodiment, the crumb catcher 40c in this embodiment is modified so that liquids do not easily leak therefrom. In addition, the improved attachment means provided for the crumb catcher of this embodiment provides a more secure assembly which particularly adapts this embodiment to institutional use.

This third embodiment has, as does the first and second embodiment, opposite top and bottom edges 21c, 22c, and opposite side edges 23c, 24c. The top edge comprises a medial top edge portion 25c and a lateral top edge portion 26c on each side thereof. A pair of elongate slots 30c extend generally along respective ones of the lateral top edge portions and the side edges of the sheet. Each of the slots includes three segments 31c, 32c, 34c, arranged like the three segments in the first and second embodiments.

Means are provided for defining a fold line 41c extending parallel to and spaced from the bottom edge. The means defining the fold line is a slot 39c formed in each side edge of the sheet. The fold line 41c runs between the two slots 39c. Attachment means are provided for securing the crumb catcher panel in an operative position, wherein the crumb catcher panel is folded along the fold line to overlie an adjacent portion of the sheet. The attachment means in this third embodiment comprises an integral connector member 44c formed at each side of the crumb catcher panel, a first pair of relatively short slots 45c in the sheet, an integral connector member formed at each side edge of the sheet 47c, and a second pair of relatively short slots 46c formed in the crumb catcher panel. The first pair of relatively short slots 45c is sized and positioned to separately receive the connector members 44c formed at each side of the crumb catcher panel when the crumb catcher panel is folded to its operative position; the second pair of relatively short slot 46c is sized and positioned to separately receive the connector members 47c formed at each side edge of the sheet when the crumb catcher panel is folded to its operative position.

In each of the illustrated embodiments, the connector members have an inclined edge 48a, 48b, 48c configured to permit the connector member to easily pass through the associated slot when the crumb catcher panel is folded to the operative position, and have an oppositely facing blocking edge 49*a*, 49*b*, 49*c* configured to hinder the connector member form easily passing through the slot after the connector member has first been passed through the slot. In the illustrated embodiments, the connector members 44*a*, 46*b*, 44*c*, 46*c* are generally triangular in shape.

Bibs of the present invention may be constructed from any suitable drapable sheet material. Preferably, the material should be a breathable material which will not obstruct a wearer's breathing if the bib is drawn across the wearer's nose and mouth. Particularly suitable materials are breathable nonwoven fabrics such as spun-bonded polyester fabrics.

In the foregoing drawings and specification, various preferred embodiments of the present invention has been disclosed. Although specific terms are employed, they are used in a generic, descriptive sense only and not for purposes of limitation, the scope of the invention being set forth in the following claims. Equivalents of the claims are to be included therein.

That which is claimed:

1. A disposable bib comprising;

a unitary sheet of drapable material having opposite top and bottom edges defining a length direction therebetween, and opposite side edges defining a width direction therebetween, a pair of slots extending generally along respective ones of said side edges of said sheet, with each of said slots including a first segment which extends along a substantial portion of the length of and generally parallel to the adjacent side edge of said sheet to a point adjacent said bottom edge of said sheet, and a second segment extending from said point to an adjacent edge of said sheet, and with each of said slots including at least one interruption which defines a bridging interconnection and which is at a location closer to said bottom edge than said top edge, and whereby said pair of slots define a pair of ties along respective opposite side edges of said sheet and such that said ties can be rendered free for use by rupturing said bridging interconnections.

2. The disposable bib as defined in claim 1, wherein said second segment of said slots extends generally in the width direction from said point to an associated side edge of said sheet.

3. The disposable bib as defined in claim 1, wherein said drapable material comprises a breathable nonwoven fabric.

4. The disposable bib as defined in claim 1, further comprising means defining a fold line extending parallel to and spaced from said bottom edge of said sheet so as to define a crumb catcher panel between said fold line and said bottom edge, and attachment means for securing said crumb catcher panel in an operative position wherein said crumb catcher panel is folded along said fold line so as to overlie an adjacent portion of said sheet.

5. The disposable bib as defined in claim 4, wherein said attachment means comprises an integral connector member formed at each side edge of said crumb catcher panel, and a pair of relatively short slots in said sheet, with said relatively short slots being sized and positioned to separately receive said connector members when said crumb catcher panel is folded to said operative position.

6. The disposable bib as defined in claim 4, wherein said attachment means comprises a pair of relatively short slots formed in said crumb catcher panel, and an integral connector member formed at each side edge of said sheet, with said relatively short slots being sized and positioned to separately receive said connector members when said crumb catcher panel is folded to said operative position.

7. The disposable bib as defined in claim 4 wherein said attachment means comprises an integral connector member formed at each side edge of said crumb catcher panel, a first pair of relatively short slots in said sheet, an integral connector member formed at each side edge of said sheet, and a second pair of relatively short slots formed in said crumb catcher panel, with said first pair of relatively short slots being sized and positioned to separately receive said connector members formed at each side edge of said crumb catcher panel when said crumb catcher panel is folded to said operative position, and with said second pair of relatively short slots being sized and positioned to separately receive said connector members formed at each side edge of said sheet when said crumb catcher panel is folded to said operative position.

8. The disposable bib as defined in claim 5, 6, or 7, wherein each of said connector members has an inclined edge configured to permit said connector member to easily pass through the associated slot when said crumb catcher panel is folded to said operative position, and an oppositely facing blocking edge configured to hinder said connector member from easily passing through said slot after said connector member has first been passed through said slot.

9. The disposable bib as claimed in claim 5, 6, or 7 wherein said connector members are generally triangular in shape.

10. A disposable bib comprising;

a unitary sheet of drapable material having opposite top and bottom edges defining a length direction therebetween, and opposite side edges defining a width direction therebetween, said top edge comprising a medial top edge portion and a lateral top edge portion on each side of said medial top edge portion, a pair of elongate slots extending generally along respective ones of said lateral top edge portions and said side edges of said sheet, with each of said slots including a first segment which extends generally parallel to the adjacent lateral top edge portion of said sheet, and a second segment which extends generally parallel to the adjacent side edge of the sheet for a substantial portion of the length of the sheet, said second segment extending to an adjacent edge of said sheet, whereby said pair of slots define a pair of ties along respective lateral top edge portions and opposite side edges of said sheet for use in securing said bib to a wearer by being tied about the neck.

11. The disposable bib as defined in claim 10, wherein said medial top edge portion is formed in a convexly inwardly curved configuration and adapted to be comfortably secured against the neck of a wearer.

12. The disposable bib as defined in claim 10, wherein said side edges are generally linear and parallel with one another.

13. The disposable bib as defined in claim 10, wherein the length of said unitary sheet exceeds the width thereof.

14. The disposable bib as defined in claim 10, further comprising means defining a fold line extending parallel to and spaced from said bottom edge of said sheet so as to define a crumb catcher panel between said fold line and said bottom edge, and attachment means for securing said crumb catcher panel in a operative position wherein said crumb catcher panel is folded along said fold line so as to overlie an adjacent portion of said sheet.

15. The disposable bib as defined in claim 14, wherein said attachment means comprises an integral connector member formed at each side edge of said crumb catcher panel, and a pair of relatively short slots in said sheet, with said relatively short slots being sized and positioned to separately receive said connector members when said crumb catcher panel is folded to said operative position.

16. The disposable bib as defined in claim 14, wherein said attachment means comprises a pair of relatively short slots formed in said crumb catcher panel, and an integral connector member formed at each side edge of said sheet, with said relatively short slots being sized and positioned to separately receive said connector members when said crumb catcher panel is folded to said operative position.

17. The disposable bib as defined in claim 14, wherein said attachment means comprises an integral connector member formed at each side edge of said crumb catcher panel, a first pair of relatively short slots in said sheet, an integral connector member formed at each side edge of said sheet, and a second pair of relatively short slots formed in said crumb catcher panel, with said first pair of relatively short slots being sized and positioned to separately receive said connector members formed at each side edge of said crumb catcher panel when said crumb catcher panel is folded to said operative position, and with said second pair of relatively short slots being sized and positioned to separately receive said connector members formed at each side edge of said sheet when said crumb catcher panel is folded to said operative position.

18. The disposable bib as defined in claim 15, 16, or 17, wherein each of said connector members has a inclined edge configured to permit said connector member to easily pass through the associated slot when said crumb catcher panel is folded to said operative position, and an oppositely facing blocking edge configured to hinder said connector member from easily passing through said slot after said connector member has first been passed through said slot.

19. The disposable bib as claimed in claim 15, 16, or 17, wherein said connector members are generally triangular in shape.

20. A disposable bib comprising;

a unitary sheet of drapable material having opposite top and bottom edges defining a length direction therebetween, and opposite side edges defining a width direction therebetween, said top edge comprising a medial top edge portion and a lateral top edge portion on each side of said medial top edge portion, a pair of elongate slots extending generally along respective ones of said lateral top edge portions and said side edges of said sheet, with each of said slots including a first segment which extends generally parallel with the adjacent lateral top edge portion of said sheet, a second segment which extends generally parallel with the adjacent side edge of the sheet to a point adjacent said bottom edge of said sheet, and a third segment extending from said point to the adjacent edge of said sheet, each of said slots including at least one interruption which defines a bridging interconnection and which is at a location closer to said bottom edge than said top edge, whereby said pair of slots define a pair of ties along respective lateral top edge portions and opposite side edges of said sheet and such that said ties can be rendered free for use by rupturing said bridging interconnections.

21. The disposable bib as defined in claim 20, wherein said third segment of said slots extends generally in the width direction from said point to the associated side edge of said sheet.

22. The disposable bib as defined in claim 20, wherein said medial top edge portion is formed in a convexly inwardly curved configuration and adapted to be comfortably secured against the neck of a wearer.

23. The disposable bib as defined in claim 20, wherein said side edges are generally linear and parallel to one another, and wherein the length of said unitary sheet exceeds the width thereof.

24. The disposable bib as defined in claim 20, wherein said drapable material comprises a breathable nonwoven fabric.

25. The disposable bib as defined in claim 20, further comprising means defining a fold line extending parallel to and spaced from said bottom edge of said sheet so as to define a crumb catcher panel between said fold line and said bottom edge, and attachment means for securing said crumb catcher panel in an operative position wherein said crumb catcher panel is folded along said fold line so as to overlie an adjacent portion of said sheet.

26. The disposable bib as defined in claim 25, wherein said attachment means comprises an integral connector member formed at each side edge of said crumb catcher panel, and a pair of relatively short slots in said sheet, with said relatively short slots being sized and positioned to separately receive said connector members when said crumb catcher panel is folded to said operative position.

27. The disposable bib as defined in claim 25, wherein said attachment means comprises a pair of relatively short slots formed in said crumb catcher panel, and an integral connector member formed at each side edge of said sheet, with said relatively short slots being sized and positioned to separately receive said connector members when said crumb catcher panel is folded to said operative position.

28. The disposable bib as defined in claim 25, wherein said attachment means comprises an integral connector member formed at each side edge of said crumb catcher panel, a first pair of relatively short slots in said sheet, an integral connector member formed at each side edge of said sheet, and a second pair of relatively short slots formed in said crumb catcher panel, with said first pair of relatively short slots being sized and positioned to separately receive said connector members formed at each side edge of said crumb catcher panel when said crumb catcher panel is folded to said operative position, and with said second pair of relatively short slots being sized and positioned to separately receive said connector members formed at each side edge of said sheet when said crumb catcher panel is folded to said operative position.

29. The disposable bib as defined in claim 26, 27, or 28, wherein each of said connector members has an inclined edge configured to permit said connector member to easily pass through the associated slot when said crumb catcher panel is folded to said operative position, and an oppositely facing blocking edge configured to hinder said connector member from easily passing through said, slot after said connector member has first been passed through said slot.

30. The disposable bib as claimed in claim 26, 27, or 28, wherein each of said connector members is generally triangular in shape.

* * * * *